US010865658B2

(12) United States Patent
Hashimoto

(10) Patent No.: US 10,865,658 B2
(45) Date of Patent: Dec. 15, 2020

(54) GAS TURBINE EXHAUST MEMBER, AND EXHAUST CHAMBER MAINTENANCE METHOD

(71) Applicant: MITSUBISHI HITACHI POWER SYSTEMS, LTD., Kanagawa (JP)

(72) Inventor: Shinya Hashimoto, Kanagawa (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 601 days.

(21) Appl. No.: 15/329,095

(22) PCT Filed: Jul. 3, 2015

(86) PCT No.: PCT/JP2015/069319
§ 371 (c)(1),
(2) Date: Jan. 25, 2017

(87) PCT Pub. No.: WO2016/031393
PCT Pub. Date: Mar. 3, 2016

(65) Prior Publication Data

US 2017/0284225 A1 Oct. 5, 2017

(30) Foreign Application Priority Data

Aug. 25, 2014 (JP) ..... 2014-170775

(51) Int. Cl.
*F01D 25/00* (2006.01)
*F01D 25/24* (2006.01)
(Continued)

(52) U.S. Cl.
CPC ..... *F01D 25/243* (2013.01); *F01D 25/14* (2013.01); *F01D 25/246* (2013.01); *F01D 25/30* (2013.01)

(58) Field of Classification Search
CPC . F01D 25/243; F01D 25/30; F02C 7/20; F16J 15/00; F16J 15/02; F16J 15/021;
(Continued)

(56) References Cited

U.S. PATENT DOCUMENTS 3,824,031 A * 7/1974 Gilbert ..... F01D 11/08 415/135
8,800,300 B2 8/2014 Hashimoto et al.
(Continued)

FOREIGN PATENT DOCUMENTS

CN 103557035 2/2014
JP 2002-13401 1/2002
(Continued)

OTHER PUBLICATIONS

International Search Report dated Oct. 6, 2015 in International (PCT) Application No. PCT/JP2015/069319.
(Continued)

*Primary Examiner* — Gerald L Sung
*Assistant Examiner* — Katheryn A Malatek
(74) *Attorney, Agent, or Firm* — Wenderoth, Lind & Ponack, L.L.P.

(57) ABSTRACT

In a gas turbine exhaust member and an exhaust chamber maintenance method, the gas turbine exhaust member is provided with: an inside diffuser that forms a tubular shape and is divided into multiple parts in the circumferential direction; a first seal housing that forms a tubular shape and is integrally formed in the circumferential direction, the front end of which being coupled to the rear end of the inside diffuser; a second seal housing that forms a tubular shape and is integrally formed in the circumferential direction, the front end of which being coupled to the rear end of the first seal housing; and a supporting coupling part that supports the rear end of the first seal housing and the front end of the
(Continued)

second seal housing so as to allow the rear end and the front end to move in the axial direction.

9 Claims, 6 Drawing Sheets

(51) Int. Cl.
*F01D 25/30* (2006.01)
*F01D 25/14* (2006.01)

(58) Field of Classification Search
CPC ..... F16J 15/022; F16J 15/06; F16J 15/062; F02K 1/80; F02K 1/04
See application file for complete search history.

(56) References Cited

U.S. PATENT DOCUMENTS

| | | | | |
|---|---|---|---|---|
| 8,844,297 | B2 | 9/2014 | Arase et al. | |
| 9,133,769 | B2 | 9/2015 | Hashimoto et al. | |
| 2010/0322759 | A1 | 12/2010 | Tanioka | |
| 2011/0005234 | A1* | 1/2011 | Hashimoto | F01D 25/30 60/796 |
| 2011/0020116 | A1* | 1/2011 | Hashimoto | F01D 25/26 415/180 |
| 2012/0163963 | A1* | 6/2012 | Hashimoto | F01D 25/243 415/182.1 |
| 2012/0219412 | A1* | 8/2012 | Nakayama | F01D 25/246 415/209.3 |
| 2012/0224960 | A1* | 9/2012 | Xu | F01D 25/246 415/215.1 |
| 2013/0236305 | A1 | 9/2013 | Hashimoto et al. | |
| 2014/0003931 | A1 | 1/2014 | Brühwiler | |
| 2014/0248146 | A1* | 9/2014 | Sander | F02C 7/20 415/213.1 |
| 2014/0311162 | A1 | 10/2014 | Hashimoto et al. | |
| 2015/0292656 | A1* | 10/2015 | Kishi et al. | |

FOREIGN PATENT DOCUMENTS

| | | |
|---|---|---|
| JP | 2009-24631 | 2/2009 |
| JP | 2009-167800 | 7/2009 |
| JP | 2009-243308 | 10/2009 |
| JP | 2011-38491 | 2/2011 |
| JP | 2014-9693 | 1/2014 |
| KR | 10-2010-0102736 | 9/2010 |
| KR | 10-2010-0113136 | 10/2010 |
| WO | 2013/132692 | 9/2013 |

OTHER PUBLICATIONS

Office Action dated Aug. 13, 2018 in corresponding Korean Application No. 10-2017-7002300, with English translation.
Written Opinion dated Oct. 6, 2015 in corresponding International (PCT) Application No. PCT/JP2015/069319.
Office Action dated Feb. 20, 2018 in Korean Patent Application No. 10-2017-7002300, with English-language translation.
Office Action dated Jun. 11, 2018 in Chinese Application No. 201580041787.9, with machine translation.

* cited by examiner

GAS TURBINE EXHAUST MEMBER, AND EXHAUST CHAMBER MAINTENANCE METHOD

TECHNICAL FIELD

The present invention relates to a gas turbine exhaust member that treats exhaust gas in a gas turbine provided with a compressor, a combustor, and a turbine, and to an exhaust chamber maintenance method.

BACKGROUND ART

A typical gas turbine is configured by a compressor, a combustor, and a turbine, for example. The compressor generates high-temperature, high-pressure compressed air by compressing air taken in from an air inlet port. The combustor obtains high-temperature, high-pressure combustion gas by supplying fuel to the compressed air and causing the fuel to be combusted. The turbine is driven by this combustion gas, and drives a power generator coaxially coupled to the turbine.

In this gas turbine, an exhaust member that forms a tubular shape is provided on the downstream side of the turbine. This exhaust member is configured by an exhaust casing, an exhaust chamber, and an exhaust duct coupled to one another in the longitudinal direction, for example. Each of the exhaust casing and the exhaust chamber is divided into upper and lower parts, taking into account the assemblability and maintainability of internal structures, such as a rotor. The upper and lower parts are fastened, at flanges, namely dividing surfaces thereof, by a plurality of fastening bolts to form a tubular shape. Further, the exhaust casing and the exhaust chamber are coupled so as to be capable of moving relative to each other in the axial direction, taking into account the fact that a thermal expansion difference occurs when exhaust gas flows therethrough. An example of such a gas turbine is disclosed in Patent Document 1 described below.

CITATION LIST

Patent Document

Patent Document 1: Japanese Unexamined Patent Application Publication No. 2009-167800A

SUMMARY OF INVENTION

Technical Problem

As described above, in the conventional gas turbine, the exhaust casing and the exhaust chamber are heated as a result of the exhaust gas flowing through the interior thereof when the gas turbine is in operation, and consequently, thermal expansion occurs in the axial and radial directions. At this time, because each of the exhaust casing and the exhaust chamber is configured by divided upper and lower parts that have been fastened by the fastening bolts on the dividing surfaces, plastic deformation occurs particularly in fastening portions configured by the fastening bolts, and plastic strain remains therein even after the gas turbine is stopped. As a result, the respective upper casings of the exhaust casing and the exhaust chamber are tightly fitted to each other, thereby making it difficult to remove the upper casings. This causes a problem in that a maintenance operation cannot be performed on the gas turbine. Further, even if the respective upper casings of the exhaust casing and the exhaust chamber have been successfully removed, the casings cannot be reassembled together because of their plastic deformation.

In order to solve the above-described problem, an object of the present invention is to provide a gas turbine exhaust member and an exhaust chamber maintenance method that are designed to simplify attachment and removal of casings and improve maintainability.

Solution to Problem

In order to achieve the above-described object, a gas turbine exhaust member of the present invention includes: a first casing that forms a tubular shape and is divided into multiple parts in a circumferential direction; a second casing that forms a tubular shape and is integrally formed in the circumferential direction, a front end of the second casing in an axial direction being coupled to a rear end of the first casing in the axial direction; a third casing that forms a tubular shape and is integrally formed in the circumferential direction, a front end of the third casing in the axial direction being coupled to a rear end of the second casing in the axial direction; and a supporting coupling part that supports the rear end of the second casing and the front end of the third casing so as to allow the rear end of the second casing and the front end of the third casing to move in the axial direction.

Thus, the second casing that is integrally formed in the circumferential direction is coupled to the first casing that is divided in the circumferential direction, and the third casing that is integrally formed in the circumferential direction is coupled to this second casing by the supporting coupling part. The third casing is supported by the supporting coupling part so that the third casing can move relative to the second casing in the axial direction. When the gas turbine is in operation, each of the casings is heated by combustion gas flowing through the interior thereof. At this time, when different amounts of thermal expansion occur in the axial and radial directions, different amounts of plastic deformation may remain as internal stress. However, since the second casing and the third casing are integrally formed in the circumferential direction, cooling the casings returns the shapes of the casings to the original shapes. This prevents the second and third casings from being closely fitted with each other, and smooth movement in the axial direction is possible due to the supporting coupling part. Since the first casing is divided into upper and lower parts, the upper part of the first casing can be easily removed, and the second casing and the third casing can be also easily separated from each other. As a result, the removal and attachment of each of the casings can be simplified, and maintainability can be improved.

In the gas turbine exhaust member of the present invention, the front end of the second casing is disposed further to the rear than a rear end of a rotating shaft disposed inside the first casing.

Such a configuration in which the front end of the second casing is disposed further to the rear than the rear end of the rotating shaft allows, with the upper part of the first casing removed, the rotating shaft to be easily moved upward without being obstructed by the second casing. Further, with fastening of a fastening portion between the first casing and the second casing released, the second casing can be easily moved upward without being obstructed by the rotating shaft.

In the gas turbine exhaust member of the present invention, a fourth casing is provided that forms a tubular shape and is divided into multiple parts in the circumferential direction. A front end of the fourth casing in the axial direction is coupled to a rear end of the third casing in the axial direction.

Thus, with such a configuration in which the front end of the fourth casing, which is divided into multiple parts in the circumferential direction, is coupled to the rear end of the third casing, removing the upper part of the fourth casing from the third casing enables the internal maintenance to be easily performed without removing the third and fourth casings.

In the gas turbine exhaust member of the present invention, the supporting coupling part is provided with a seal member that seals a gap between the second casing and the first casing.

Thus, the seal member can prevent leakage of the combustion gas from the supporting coupling part.

In the gas turbine exhaust member of the present invention, a first flange portion forming a ring shape is provided on the rear end of the first casing, a second flange portion forming a ring shape is provided on the front end of the second casing, a plurality of through-holes are formed in one of the first flange portion and the second flange portion along the circumferential direction, and a plurality of long holes extending in a radial direction are formed in the other of the first flange portion and the second flange portion along the circumferential direction. Fastening bolts pass through the through-holes and are inserted through the long holes, urging members are disposed adjacent to the long holes, and fastening nuts are screwed onto threaded tip portions of the fastening bolts.

Thus, when a difference in thermal expansion in the radial direction occurs between the first casing and the second casing, the first flange portion and the second flange portion are displaced in the radial direction, exerting a shearing force on the fastening bolts in the radial direction. However, since a shaft portion of the fastening bolt, for which sufficient strength can be secured, passes through the through-hole, breakage of the fastening bolt can be inhibited.

An exhaust chamber maintenance method of the present invention is a maintenance method for a gas turbine exhaust member that includes: a first casing that forms a tubular shape and is divided into multiple parts in a circumferential direction; a second casing that forms a tubular shape and is integrally formed in the circumferential direction, a front end of the second casing in an axial direction being coupled to a rear end of the first casing in the axial direction; a third casing that forms a tubular shape and is integrally formed in the circumferential direction, a front end of the third casing in the axial direction being coupled to a rear end of the second casing in the axial direction; and a supporting coupling part that supports the rear end of the second casing and the front end of the third casing so as to allow the rear end of the second casing and the front end of the third casing to move in the axial direction, the front end of the second casing being disposed further to the rear than a rear end of a rotating shaft disposed inside the first casing. The exhaust chamber maintenance method includes the steps of: releasing fastening of a dividing portion of the first casing; releasing fastening between the first casing and the second casing; and removing the dividing portion of the first casing.

Such a configuration allows, with the upper part of the first casing removed, the rotating shaft to be easily moved upward without being obstructed by the second casing.

Advantageous Effects of Invention

According to the gas turbine exhaust member and the exhaust chamber maintenance method of the present invention, the second casing that is integrally formed in the circumferential direction is coupled to the first casing that is divided into multiple parts in the circumferential direction, and the third casing that is integrally formed in the circumferential direction is coupled to the second casing so that the second casing and the third casing are movable in the axial direction, thereby enabling smooth movement of the second casing and the third casing. As a result, the removal and attachment of each of the casings can be simplified and maintainability can be improved.

DESCRIPTION OF EMBODIMENT

A preferred embodiment of a gas turbine exhaust member and an exhaust chamber maintenance method according to the present invention will be described in detail below with reference to the accompanying drawings. Note that the present invention is not limited by this embodiment, and, when there are a plurality of embodiments, includes combinations of these various embodiments.

Figure 6:
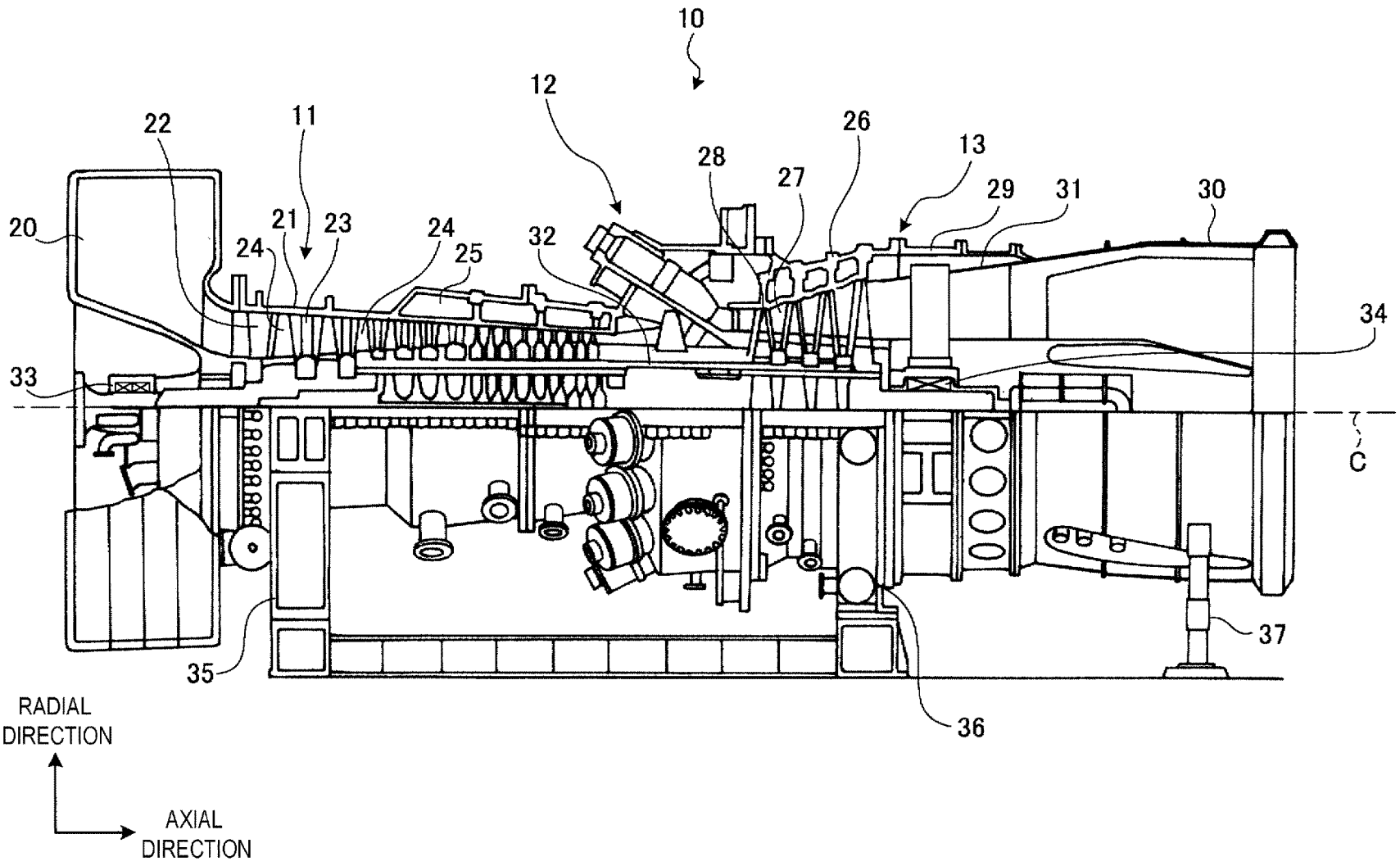
FIG. 6 is a schematic view illustrating the overall configuration of a gas turbine.

FIG. 6 is a schematic view illustrating the overall configuration of a gas turbine according to the present embodiment.

As illustrated in FIG. 6, in the present embodiment, a gas turbine 10 is configured by a compressor 11, combustors 12, and a turbine 13. In this gas turbine 10, the compressor 11 and the turbine 13 are disposed on the outer side of a rotor (rotating shaft) 32 along the direction of an axial center C (hereinafter referred to as an axial direction), and a plurality of combustors 12 are disposed between the compressor 11 and the turbine 13. The gas turbine 10 is coaxially coupled to a power generator (an electric motor) that is not illustrated in the drawings, and is capable of generating power.

The compressor 11 includes an air inlet port 20 that takes in air. In a compressor casing 21, inlet guide vanes (IGVs) 22 are disposed, and a plurality of vanes 23 and a plurality of blades 24 are disposed alternately in the flow direction of the air (the direction of the axial center C). An extraction chamber 25 is provided on the outer side of the compressor casing 21. This compressor 11 generates high-temperature, high-pressure compressed air by compressing the air taken in from the air inlet port 20, and supplies the compressed air to the combustors 12. The compressor 11 can be started up by an electric motor coaxially coupled thereto.

Fuel, and the high-temperature, high-pressure compressed air, which has been compressed by the compressor 11 and accumulated in a turbine casing 26, are supplied to the combustors 12, and the combustors 12 generate combustion gas by causing the compressed air and the fuel to be combusted. In the turbine 13, a plurality of vanes 27 and a plurality of blades 28 are disposed alternately inside the turbine casing 26 in the flow direction of the combustion gas (the axial direction). Further, in this turbine casing 26, an exhaust chamber 30 is disposed on the downstream side via an exhaust casing 29. This exhaust chamber 30 includes an exhaust diffuser 31 that is coupled to the turbine 13. The turbine 13 is driven by the combustion gas supplied from the combustors 12, and can drive the power generator coaxially coupled to the turbine 13.

Inside the compressor 11, the combustors 12, and the turbine 13, the rotor 32 is disposed along the axial direction so as to pass through a center portion of the exhaust chamber 30. The end of the rotor 32 on the compressor 11 side is rotatably supported by a shaft bearing 33, and the end on the exhaust chamber 30 side is rotatably supported by a shaft bearing 34. In the compressor 11, the rotor 32 is fixed by a plurality of disks that each have the blades 24 mounted thereon and are arranged side by side. Further, in the turbine 13, the rotor 32 is fixed by a plurality of disks that each have the blades 28 mounted thereon and are arranged side by side. Then, the end of the rotor 32 on the air inlet port 20 side is coupled to a drive shaft of the power generator.

Of the gas turbine 10, the compressor casing 21 of the compressor 11 is supported by a leg 35, the turbine casing 26 of the turbine 13 is supported by a leg 36, and the exhaust chamber 30 is supported by a leg 37.

Accordingly, the air taken in from the air inlet port 20 of the compressor 11 passes through the inlet guide vanes 22 and the plurality of vanes 23 and blades 24, and is compressed, thereby converting the air to the high-temperature, high-pressure compressed air. A predetermined fuel is supplied into the compressed air and combusted in the combustors 12. In the turbine 13, the high-temperature, high-pressure combustion gas generated by the combustors 12 passes through the plurality of vanes 27 and blades 28 of the turbine 13, thereby driving the rotation of the rotor 32 and, in turn, driving the power generator coupled to the rotor 32. Then, the combustion gas that has driven the turbine 13 is released into the atmosphere as exhaust gas.

In the gas turbine 10 configured as described above, the turbine casing 26, the exhaust casing 29, and the exhaust chamber 30 are provided as an exhaust member forming a tubular shape.

Figure 1:
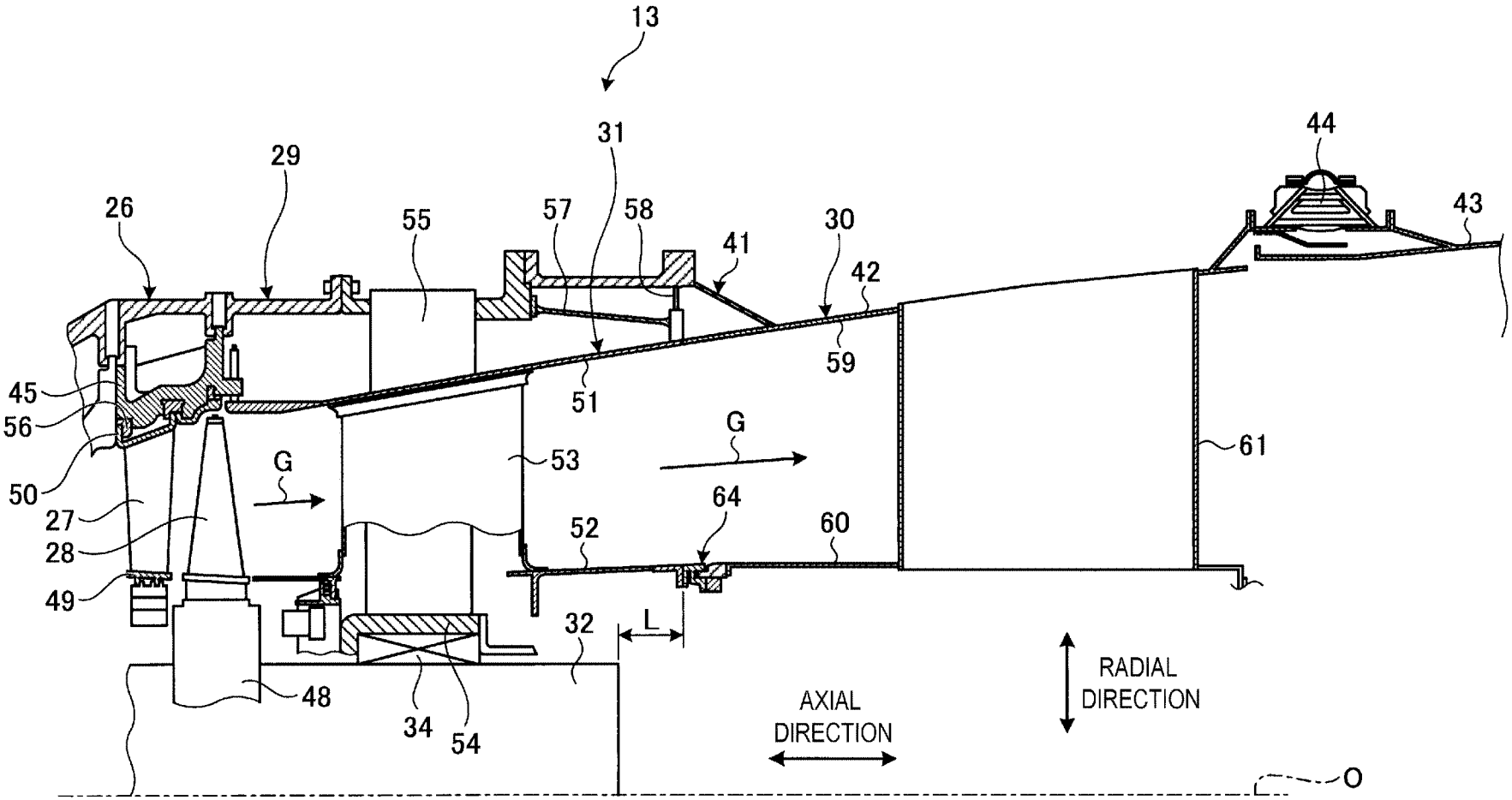
FIG. 1 is a cross-sectional view illustrating a gas turbine exhaust member of a present embodiment.

FIG. 1 is a cross-sectional view illustrating a gas turbine exhaust member of the present embodiment. Note that the flow direction of combustion gas (exhaust gas) G in the gas turbine 10 is a direction extending along the axial direction of the rotor 32 (the direction of the axial center C), and in the description below, the upstream side in the flow direction of the combustion gas G will be referred to as a front side (to the front), and the downstream side (to the rear) in the flow direction of the combustion gas G will be referred to as a rear side.

As illustrated in FIG. 1, the turbine casing 26 forms a tubular shape, the plurality of vanes 27 and blades 28 are disposed alternately along the axial direction, and the exhaust casing 29 is disposed on the downstream side in the flow direction of the combustion gas G. The exhaust casing 29 forms a tubular shape, and the exhaust chamber 30 is disposed on the downstream side in the flow direction of the combustion gas G. This exhaust chamber 30 forms a tubular shape. Then, the exhaust casing 29 and the exhaust chamber 30 are coupled to each other by exhaust chamber supports 41 which can absorb thermal expansion. Further, the exhaust chamber 30 is configured by a front exhaust chamber 42 and a rear exhaust chamber 43. The front exhaust chamber 42 and the rear exhaust chamber 43 are coupled to each other by an expansion joint 44 which can absorb thermal expansion.

Blade rings 45 are fixed in the flow direction of the combustion gas G at predetermined intervals on an inner circumferential portion of the turbine casing 26. A plurality of disks 48 are integrally connected to an outer circumferential portion of the rotor 32. The blades 28 are disposed in the circumferential direction at equal intervals, and the base ends of the blades 28 are fixed to outer circumferential portions of the disks 48.

The vanes 27 are disposed in the circumferential direction at equal intervals. The inner ends of the vanes 27 in the radial direction are fixed to an inner shroud 49 that forms a ring shape, and the outer ends of the vanes 27 in the radial direction are fixed to an outer shroud 50 that forms a ring shape. The outer shroud 50 is supported by the blade rings 45.

The exhaust diffuser 31 that forms a tubular shape is disposed inside the exhaust casing 29. This exhaust diffuser 31 includes an outside diffuser 51 and an inside diffuser 52, both of which form a tubular shape, coupled to each other by strut shields 53. Each of the strut shields 53 has a hollow structure formed in a tubular shape or an elliptic tubular shape, and is inclined at a predetermined angle in the circumferential direction with respect to the radial direction. A plurality of the strut shields 53 are provided in the circumferential direction of the exhaust diffuser 31 at equal intervals. Then, the shaft bearing 34 is supported by a bearing housing 54 on an inner circumferential portion of the inside diffuser 52, and the rotor 32 is rotatably supported by the shaft bearing 34. A strut 55 is disposed inside each of the strut shields 53. The inner end of the strut 55 in the radial direction is fixed to the bearing housing 54, and the outer end in the radial direction is fixed to the exhaust casing 29. Note that the strut shield 53 allows cooling air to be supplied from the outside into the inner space, thereby being able to cool the exhaust diffuser 31.

The rear end of the outside diffuser 51 of the exhaust diffuser 31 is coupled to the exhaust casing 29 by diffuser supports 57. Each of the diffuser supports 57 forms a rectangular strip shape, and extends along the axial direction. The diffuser supports 57 are provided side by side in the circumferential direction at predetermined intervals. A first end of the diffuser support 57 is fastened to the exhaust casing 29, and a second end is fastened to the outside diffuser 51. When thermal expansion occurs due to a difference in temperature between the exhaust casing 29 and the exhaust diffuser 31, the diffuser supports 57 are capable of deforming to absorb the thermal expansion. The exhaust casing 29 is provided so as to cover the diffuser supports 57 from the outside, and a gas seal 58 is provided between the rear end of the exhaust casing 29 and the rear end of the outside diffuser 51.

A tubular outer cylinder 59 and inner cylinder 60 are coupled to each other by hollow struts 61 to form the front exhaust chamber 42 of the exhaust chamber 30. Each of the hollow struts 61 has a hollow structure formed in a tubular shape or an elliptic tubular shape, and the hollow struts 61 are provided in the circumferential direction of the exhaust chamber 30 at equal intervals. The hollow struts 61 are open on the outer cylinder 59 side of the exhaust chamber 30, and the interior of each of the hollow struts 61 communicates with the atmosphere.

The rear end of the exhaust casing 29 and the front exhaust chamber 42 are coupled to each other by the exhaust chamber support 41. With respect to the exhaust diffuser 31 and the front exhaust chamber 42, the rear end of the outside diffuser 51 and the front end of the outer cylinder 59 face each other in close proximity, and the rear end of the inside diffuser 52 and the front end of the inner cylinder 60 face each other in close proximity. The outside diffuser 51 and the outer cylinder 59 each have a diameter that expands toward the downstream side in the flow direction of the combustion gas G, while the inside diffuser 52 and the inner cylinder 60 each have a constant diameter toward the downstream side in the flow direction of the combustion gas G. The exhaust chamber support 41 forms a rectangular strip shape, and extends along the axial direction. A plurality of the exhaust chamber supports 41 are provided side by side in the circumferential direction at predetermined intervals. Further, the front end of the exhaust chamber support 41 is fastened to the exhaust casing 29, and the rear end thereof is fastened to the outer cylinder 59 of the front exhaust chamber 42.

Further, a seal member 64 is provided between the rear end of the inside diffuser 52 and the front end of the inner cylinder 60. When thermal expansion occurs due to a difference in temperature between the exhaust casing 29 and the exhaust chamber 30, the exhaust chamber supports 41 are capable of deforming to absorb the thermal expansion. Further, when thermal expansion occurs due to a difference in temperature between the exhaust casing 29 and the exhaust chamber 30, the seal member 64 is capable of moving relatively in the axial direction to absorb the thermal expansion.

Figure 2:
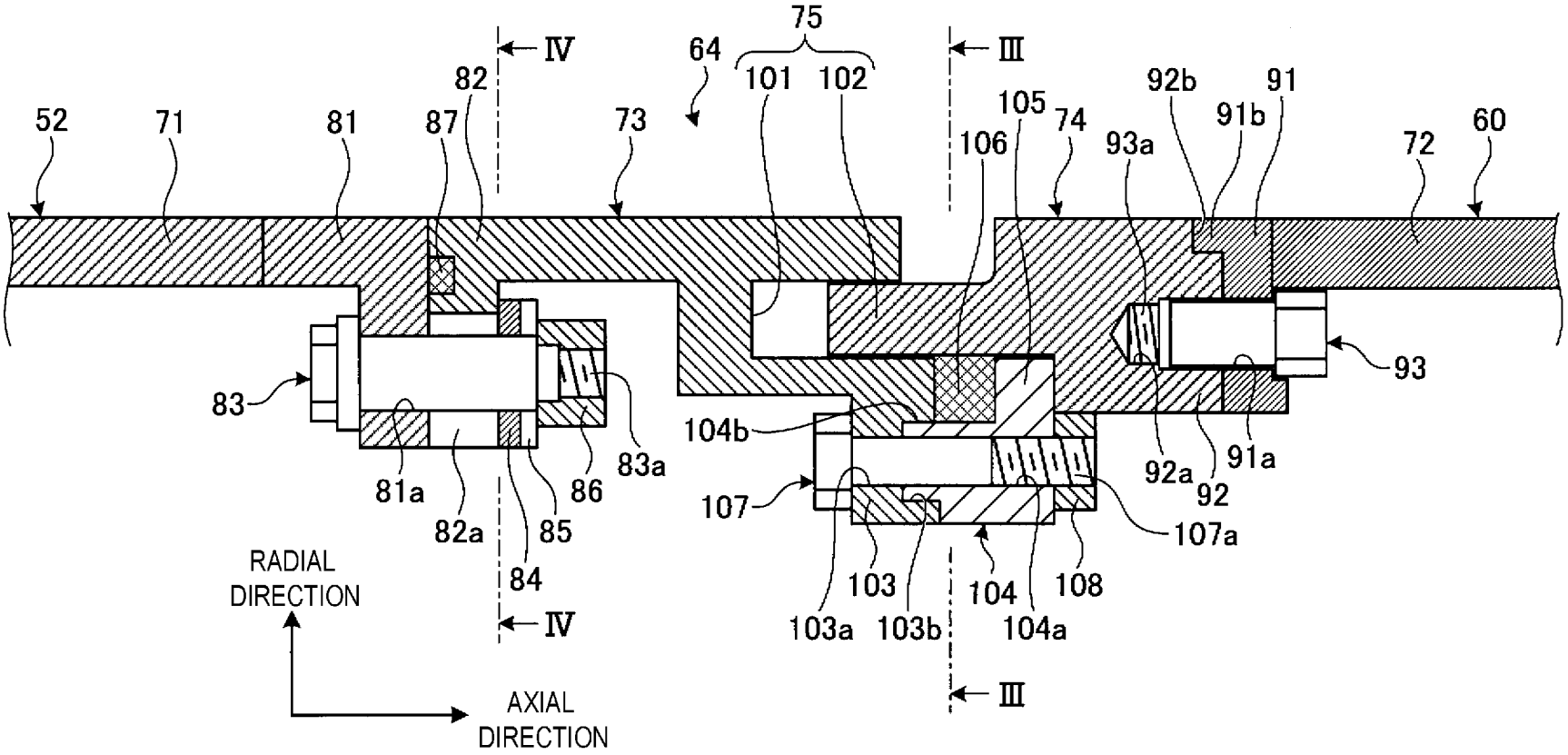
FIG. 2 is a cross-sectional view illustrating a seal member provided in a coupling portion that couples an inside diffuser with an inner cylinder.
Figure 3:
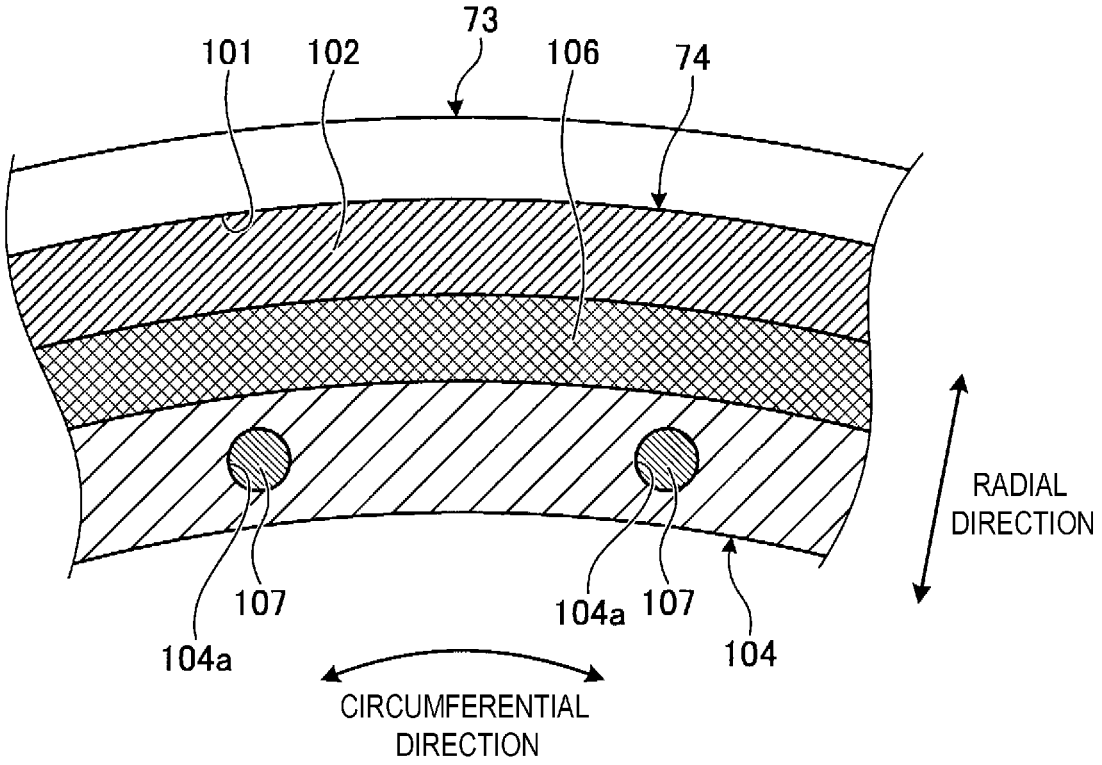
FIG. 3 is a cross-sectional view taken along a line in FIG. 2.

Here, this seal member 64 will be described in detail. FIG. 2 is a cross-sectional view illustrating the seal member 64 provided in a coupling portion that couples the inside diffuser 52 with the inner cylinder 60. FIG. 3 is a cross-sectional view taken along a line in FIG. 2, FIG. 4 is a cross-sectional view taken along a line IV-IV in FIG. 2, and FIG. 5 is a cross-sectional view illustrating a coupling portion that couples the inside diffuser 52 with the seal member 64.

Figure 4:
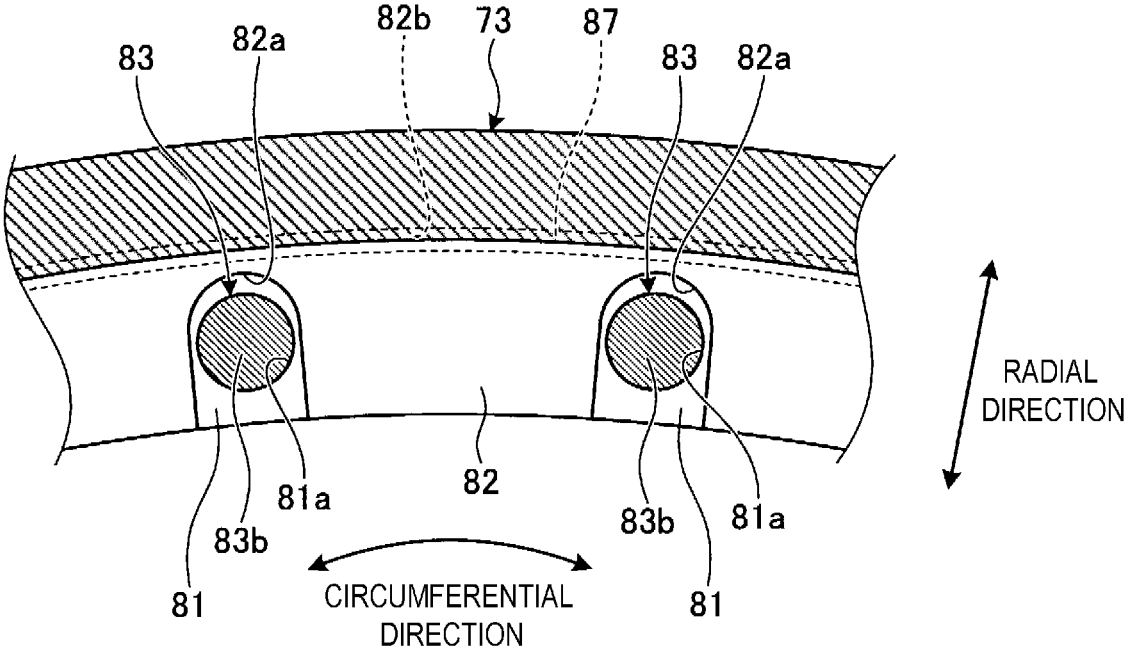
FIG. 4 is a cross-sectional view taken along a line IV-IV in FIG. 2.

As illustrated in FIGS. 2 to 4, the inside diffuser (first casing) 52 is configured by circumferentially divided parts (two parts in the present embodiment), namely an upper casing 71 and a lower casing (not illustrated). The inside diffuser 52 forms a tubular shape as a result of flange portions provided on dividing surfaces of horizontal portions being fastened by fastening bolts. The inner cylinder (fourth casing) 60 is configured by circumferentially divided parts (two parts in the present embodiment), namely an upper casing 72 and a lower casing (not illustrated). The inner cylinder 60 forms a tubular shape as a result of flange portions provided on dividing surfaces of horizontal portions being fastened by fastening bolts. The seal member 64 is configured by a first seal housing (second casing) 73, a second seal housing (third casing) 74, and a supporting coupling part 75.

The first seal housing 73 forms a tubular shape, is integrally formed in the circumferential direction, and has a structure with no dividing surfaces that can be separated in the circumferential direction. The front end of the first seal housing 73 in the axial direction is coupled to the rear end of the inside diffuser 52 in the axial direction. The second seal housing 74 forms a tubular shape, is integrally formed in the circumferential direction, and has a structure with no dividing surfaces that can be separated in the circumferential direction. The rear end of the second seal housing 74 in the axial direction is coupled to the front end of the inner cylinder 60 in the axial direction. The supporting coupling part 75 restrains the rear end of the first seal housing 73 and the front end of the second seal housing 74 in the radial direction, and supports the rear end of the first seal housing 73 and the front end of the second seal housing 74 such that they can move relative to each other in the axial direction.

Figure 5:
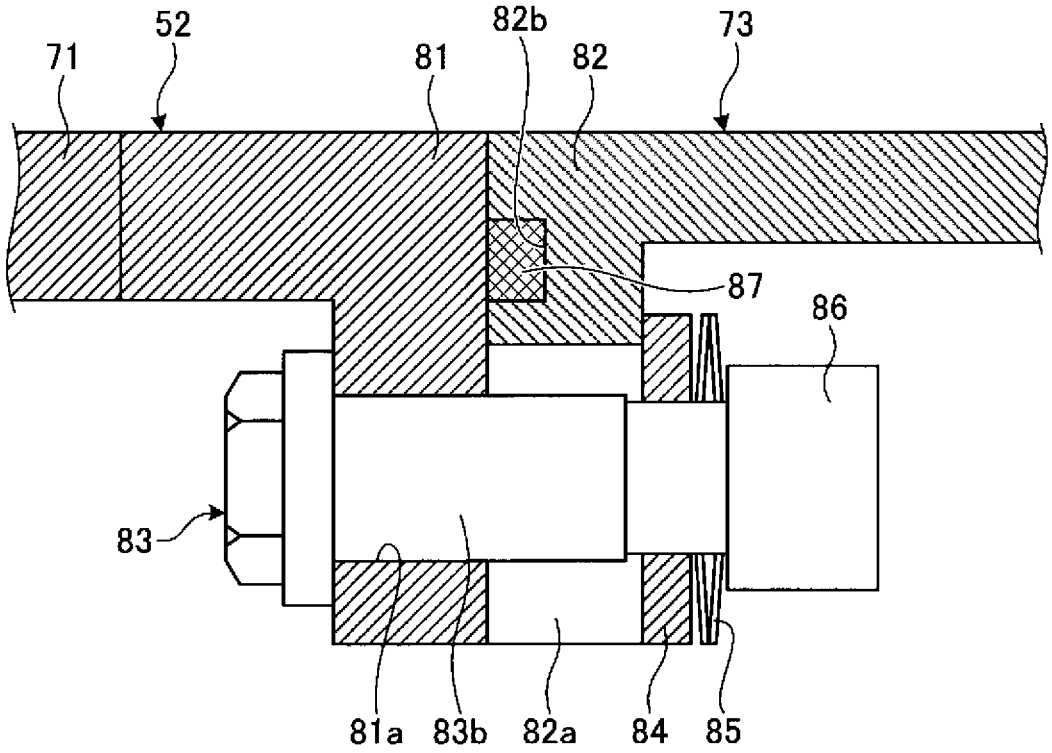
FIG. 5 is a cross-sectional view illustrating a coupling portion that couples the inside diffuser with the seal member.

As illustrated in FIGS. 4 and 5, a first flange portion 81, which is bent inward in the radial direction, is provided on the rear end of the inside diffuser 52 along the circumferential direction, and a plurality of through-holes 81*a* are formed in the first flange portion 81 at predetermined intervals (preferably at equal intervals) in the circumferential direction. A second flange portion 82, which is bent inward in the radial direction, is provided on the front end of the first seal housing 73 along the circumferential direction, and a plurality of notched portions 82*a* are formed in the second flange portion 82 at predetermined intervals (preferably at equal intervals) in the circumferential direction. The notched portion 82*a* has a circular arc having a diameter larger than that of the through-hole 81*a*, and is open on the inner circumferential side of the second flange portion 82. Further, the through-holes 81*a* and the notched portions 82*a* are formed at the same positions in the circumferential direction.

The first flange portion 81 of the inside diffuser 52 is in close contact with the second flange portion 82 of the first seal housing 73, and each of the through-holes 81*a* of the first flange portion 81 is matched with each of the notched portions 82*a* of the second flange portion 82. A fastening bolt 83 passes through the through-hole 81*a* from the inside diffuser 52 side, and is inserted through the notched portion 82*a*. After that, a presser ring 84 and a disc spring (urging member) 85 are disposed on the fastening bolt 83, before a fastening nut 86 is screwed onto a threaded tip portion 83*a* of the fastening bolt 83. Here, while a large diameter portion 83*b* of the fastening bolt 83 fits with the through-hole 81*a*, the large diameter portion 83*b* loosely fits with the notched portion 82*a*. Thus, the urging force of the disc spring 85 causes the first flange portion 81 and the second flange portion 82 to be in close contact with each other, and in resistance to the urging force of the disc spring 85, the inside diffuser 52 and the first seal housing 73 can move relative to each other in the radial and circumferential directions over a gap between the large diameter portion 83*b* of the fastening bolt 83 and the notched portion 82*a*.

Further, in the first seal housing 73, a groove portion 82*b* is formed in the front surface of the second flange portion 82 along the circumferential direction, and a seal packing 87 is provided in the groove portion 82*b*. Thus, when the first flange portion 81 of the inside diffuser 52 is in close contact with the second flange portion 82 of the first seal housing 73, the seal packing 87 of the second flange portion 82 is crushed and pressed to the first flange portion 81, and the inside diffuser 52 and the first seal housing 73 are coupled to each other without any gap therebetween.

Further, as illustrated in FIGS. 2 to 4, a fourth flange portion 91, which is bent inward in the radial direction, is provided on the front end of the inner cylinder 60 along the circumferential direction, and a plurality of through-holes 91*a* are formed in the fourth flange portion 91 at predetermined intervals (preferably at equal intervals) in the circumferential direction. Further, in the inner cylinder 60, a protruding portion 91*b* is formed on the front surface side of the fourth flange portion 91 along the circumferential direction. A third flange portion 92, which is bent inward in the radial direction, is provided on the rear end of the second seal housing 74 along the circumferential direction, and a plurality of screw hole portions 92*a* are formed in the third flange portion 92 at predetermined intervals (preferably at equal intervals) in the circumferential direction. The through-holes 91*a* and the screw hole portions 92*a* are formed at the same positions in the circumferential direction. Further, in the second seal housing 74, a recessed portion 92*b* is formed on the rear surface side of the third flange portion 92 along the circumferential direction.

The fourth flange portion 91 of the inner cylinder 60 is in close contact with the third flange portion 92 of the second seal housing 74, and each of the through-holes 91*a* of the fourth flange portion 91 is matched with each of the screw hole portions 92*a* of the third flange portion 92. At this time, fitting the protruding portion 91*b* of the fourth flange portion 91 in the inner cylinder 60 into the recessed portion 92*b* of the third flange portion 92 in the second seal housing 74 positions the inner cylinder 60 and the second seal housing 74 in the radial direction. A fastening bolt 93 passes through the through-hole 91*a* from the inner cylinder 60 side, and a threaded portion 93*a* is screwed into the screw hole portion 92*a*. The fourth flange portion 91 and the third flange portion 92 are in close contact with each other, thereby causing the inner cylinder 60 and the second seal housing 74 to be fixed to each other.

Further, a recessed fitting portion 101, which forms a groove shape, is provided in a rear portion of the first seal housing 73 along the circumferential direction. Meanwhile, a protruding fitting portion 102, which forms a flange shape, is provided in a front portion of the second seal housing 74 along the circumferential direction. The protruding fitting portion 102 of the second seal housing 74 is fitted into the recessed fitting portion 101 of the first seal housing 73, and the seal housings 73 and 74 are coupled to each other so as to be capable of moving relative to each other along the axial and circumferential directions. Note that since each of the first and second seal housings 73 and 74 can move relative to each other along the axial and circumferential directions, a slight gap in the radial direction is secured therebetween. The supporting coupling part 75 is configured by the recessed fitting portion 101 and the protruding fitting portion 102. Note that the supporting coupling part 75 is not limited to that configured by the combination of the protruding fitting portion 102 and the recessed fitting portion 101. For example, the supporting coupling part 75 may have a configuration in which the outer circumference of the second seal housing 74 is simply fitted together with the inner circumference of the first seal housing 73 or vice versa.

In the first seal housing 73, a flange portion 103 is provided on the inner side of the recessed fitting portion 101 along the circumferential direction, and a plurality of through-holes 103*a* are formed in the flange portion 103 at predetermined intervals (preferably at equal intervals) in the circumferential direction. A large diameter portion 103*b* is formed at the end of each of the through-holes 103*a*. A third seal housing 104 forms a ring shape. A flange portion 105 is provided on the outer side of the third seal housing 104 along the circumferential direction, and a plurality of through-holes 104*a* are formed in the third seal housing 104 at predetermined intervals (preferably at equal intervals) in the circumferential direction. Further, a boss portion 104*b* is formed at the end of each of the through-holes 104*a*. Note that although the third seal housing 104 is configured by a plurality of housings separate in the circumferential direction (four housings in the present embodiment), taking assemblability into account, the third seal housing 104 may be formed integrally in the circumferential direction.

A seal packing (seal member) 106 is provided so as to seal a slight gap in the radial direction between the recessed fitting portion 101 and the protruding fitting portion 102 in the supporting coupling part 75. The seal packing 106 forms a ring shape, has a rectangular cross-sectional shape, and is interposed between the flange portion 103 of the first seal housing 73 and the flange portion 105 of the third seal housing 104.

The flange portion 103 of the first seal housing 73 is in close contact with the third seal housing 104, and each of the through-holes 103*a* is matched with each of the through-holes 104*a*. At this time, fitting the boss portions 104*b* into the large diameter portions 103*b* positions the first seal housing 73 and the third seal housing 104 in the radial and circumferential directions. Further, the seal packing 106 is interposed between the flange portion 103 of the first seal housing 73 and the flange portion 105 of the third seal housing 104. A fastening bolt 107 passes through the through-holes 103*a* and 104*a* from the first seal housing 73 side, and a fastening nut 108 is screwed onto a threaded portion 107*a*. As a result, the flange portion 103 of the first seal housing 73 and the third seal housing 104 are fixed while being in close contact with each other. At this time, the seal packing 106 is crushed in the axial direction and deforms so as to protrude outward in the radial direction, which causes the seal packing 106 to press the inner circumferential surface of the second seal housing 74 to seal the slight gap between the recessed fitting portion 101 and the protruding fitting portion 102 in the radial direction.

Further, as illustrated in FIG. 1, the seal member 64 is disposed further to the rear than the rear end of the rotor 32. Specifically, the front end of the first seal housing 73, which forms the seal member 64, is disposed further to the rear than the rear end of the rotor 32. Specifically, the front end of the first seal housing 73 is separated from the rear end of the rotor 32 (the bearing housing 54) by a distance L. However, it is only required that the supporting coupling part 75 allow the first seal housing 73 and the second seal housing 74 to move relative to each other in the axial direction, and that the front end of the first seal housing 73 be disposed further to the rear than the rear end of the rotor 32 at least when the first seal housing 73 has moved to the rear.

When maintenance is performed on internal structures of the gas turbine 10 having the above-described configuration, an upper casing of the turbine casing 26, an upper casing of the exhaust casing 29, an upper casing of the exhaust chamber 30, an upper casing of the outside diffuser 51, and the upper casing 71 of the inside diffuser 52 are removed, before the maintenance is performed. However, the first seal housing 73, the second seal housing 74, the supporting coupling part 75, the third seal housing 104, and the like, which form the seal member 64, remain without being removed.

When the combustion gas (exhaust gas) G flows through the interior of the gas turbine 10, the exhaust diffuser 31 (the outside diffuser 51 and the inside diffuser 52) and the front exhaust chamber 42 (the outer cylinder 59 and the inner cylinder 60) are heated, and as a result, thermal expansion occurs. This thermal expansion takes place in each of the members in the axial, radial and circumferential directions, and is absorbed by each of the supports 41 and 57 and the supporting coupling part 75 of the seal member 64. However, in some cases, the occurrence of the thermal expansion results in plastic deformation in each of the members, which may cause plastic strain to remain after the gas turbine 10 is stopped. This results in the amount of the plastic strain in the exhaust diffuser 31 being different from that in the front exhaust chamber 42, which may cause galling.

However, in the present embodiment, the first seal housing 73 and the second seal housing 74, which form the seal member 64, are integrally formed in the circumferential direction, eliminating the need of a coupling portion with a fastening bolt. Thus, the amount of plastic strain generated itself is small, and further, even when the plastic stain is generated, the perfect circular shape is maintained. As a result, the galling does not occur between the first seal housing 73 and the second seal housing 74 in the supporting coupling part 75, and smooth movement in the axial and circumferential directions is secured. Further, since each of the notched portions 82*a* has the circular arc with the diameter larger than the through-hole 81*a* (the large diameter portion 83*b* of the fastening bolt 83), even when the upper casing 71 of the inside diffuser 52 slightly deforms, the first seal housing 73 can be easily removed, and can also be easily attached.

Further, since the front end of the first seal housing 73 is disposed further to the rear than the rear end of the rotor 32, even without removing the first seal housing 73 and the second seal housing 74, after removing the upper casing 71 of the inside diffuser 52 from the first seal housing 73, the rotor 32 can be easily moved upward and removed, and can also be easily moved downward and attached.

Note that although the above describes that the first seal housing 73, the second seal housing 74, the supporting coupling part 75, the third seal housing 104, and the like, all of which form the seal member 64, remain without being removed, some or all thereof may be removed. At this time, since the smooth movement, in the axial and circumferential directions, of the first seal housing 73 and the second seal housing 74 is secured due to the supporting coupling part 75, the first seal housing 73 and the second seal housing 74 can easily be separated from each other.

As described above, the gas turbine exhaust member of the present embodiment is provided with: the inside diffuser 52 that forms a tubular shape and is divided into multiple parts in the circumferential direction; the first seal housing 73 that forms a tubular shape, is integrally formed in the circumferential direction, and the front end of which is coupled to the rear end of the inner diffuser 52; the second seal housing 74 that forms a tubular shape, is integrally formed in the circumferential direction, and the front end of which is coupled to the rear end of the first seal housing 73; and the supporting coupling part 75 that supports the rear end of the first seal housing 73 and the front end of the second seal housing 74 so as to allow the rear end of the first seal housing 73 and the front end of the second seal housing 74 to move in the axial direction.

Thus, the first seal housing 73 that is integrally formed in the circumferential direction is coupled to the inside diffuser 52 that is divided in the circumferential direction, and the second seal housing 74 that is integrally formed in the circumferential direction is coupled to this first seal housing 73 by the supporting coupling part 75 so as to be capable of moving in the axial direction. When the gas turbine 10 is in operation, assuming the inside diffuser 52 and each of the seal housings 73 and 74 are heated by the combustion gas G flowing through the interior thereof and different amounts of thermal expansion occur in the axial and radial directions, different amounts of plastic deformation may remain as internal stress.

However, since each of the seal housings 73 and 74 is integrally formed in the circumferential direction, after the seal housings 73 and 74 are cooled, the shapes thereof return to the original shapes. Thus, the coupling portion of the seal housings 73 and 74 is not closely fitted and smooth movement in the axial direction is possible due to the supporting coupling portion. Thus, the upper casing 71 of the inside diffuser 52 can be easily removed, and the seal housings 73 and 74 can be easily separated from each other. As a result, the removal and attachment of the upper casing 71 can be simplified, and maintainability can be improved.

Figure 7A:
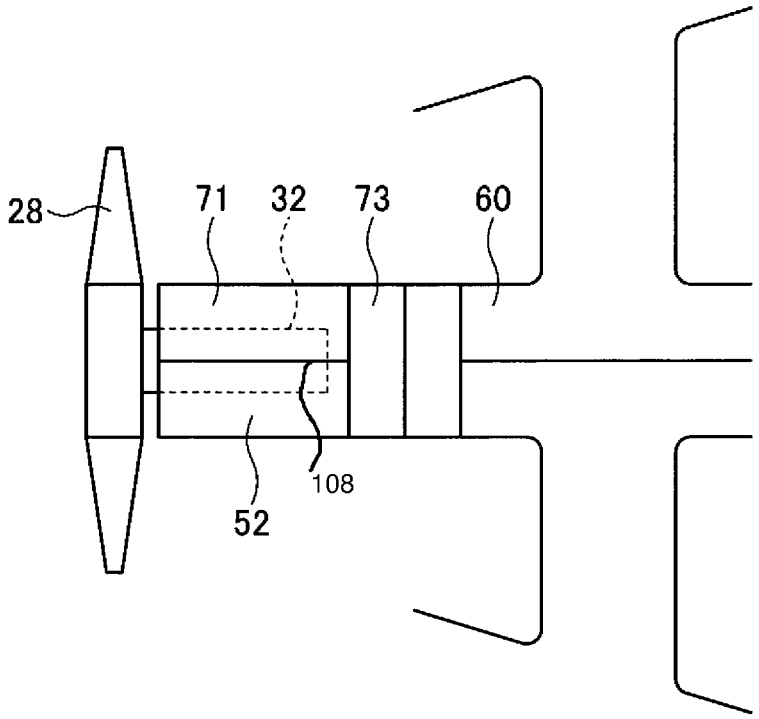
FIG. 7A is a schematic view conceptually illustrating the gas turbine exhaust member of the present embodiment.
Figure 7B:
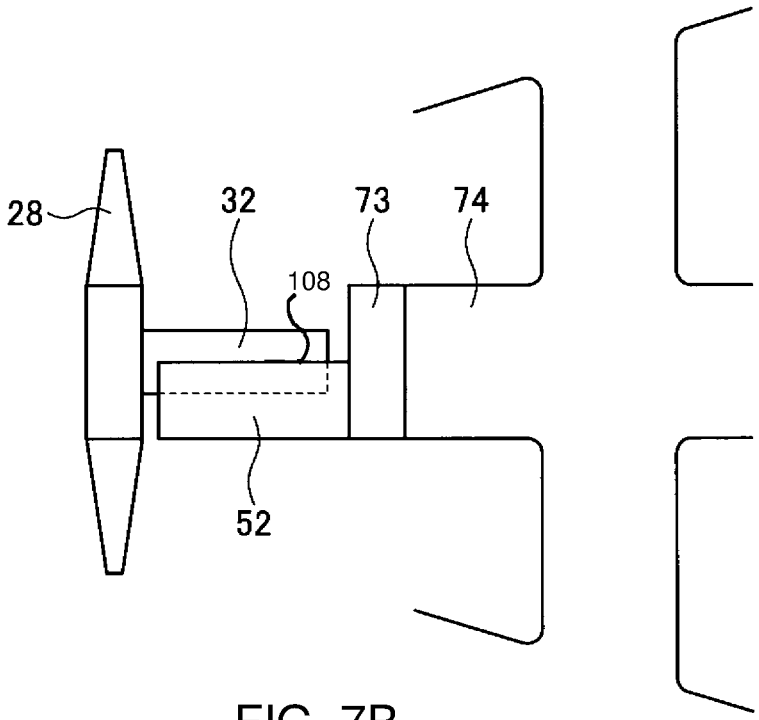
FIG. 7B is a schematic view conceptually illustrating an exhaust chamber maintenance method of the present embodiment.

The following description will be made with reference to FIGS. 7A and 7B. FIG. 7A is a schematic view conceptually illustrating the gas turbine exhaust member of the present embodiment, and FIG. 7B is a schematic view conceptually illustrating an exhaust chamber maintenance method of the present embodiment.

In the gas turbine exhaust member of the present embodiment, the front end of the first seal housing 73 is disposed further to the rear than the rear end of the rotor 32. In this case, when the first seal housing 73 is caused to move toward the second seal housing 74 side by the supporting coupling part 75, the front end of the first seal housing 73 is disposed further to the rear than the rear end of the rotor 32 (see FIG. 7A). Thus, after removing the upper casing 71 of the inside diffuser 52, the rotor 32 can be easily moved upward and removed without being obstructed by the first seal housing 73 (see FIG. 7B). Further, after removing the upper casing 71 of the inside diffuser 52, the first seal housing 73 can be easily moved upward and removed without being obstructed by the rotor 32. Furthermore, since the position of the first seal housing 73 is set while taking into account the movement stroke of each of the seal housings 73 and 74 caused by the supporting coupling part 75, the maintainability can be improved.

In the gas turbine exhaust member of the present embodiment, the front end of the inner cylinder 60 of the front exhaust chamber 42, which forms a tubular shape and is divided into multiple parts in the circumferential direction, is coupled to the rear end of the second seal housing 74. Thus, removing the upper part of the inner cylinder 60 from the second seal housing 74 enables the internal maintenance to be easily performed without removing each of the seal housings 73 and 74.

In the gas turbine exhaust member of the present embodiment, the ring-shaped seal packing 106 is provided in the supporting coupling part 75 so as to seal the gap between the first seal housing 73 and the second seal housing 74. Thus, leakage of the combustion gas G from the supporting coupling part 75 can be prevented by the seal packing 106.

In the gas turbine exhaust member of the present embodiment, the ring-shaped first flange portion 81 is provided on the rear end of the inside diffuser 52, the ring-shaped second flange portion 82 is provided on the front end of the first seal housing 73, the plurality of through-holes 81*a* are formed in the first flange portion 81 in the circumferential direction, and the plurality of notched portions 82*a*, which extend along the radial direction, are formed in the second flange portion 82 in the circumferential direction. Each of the fastening bolts 83 passes through the through-hole 81*a*, and is inserted through the notched portion 82*a*, and the disc spring 85 is disposed on the fastening bolt 83 so as to be in close proximity to the notched portion 82*a*, before the fastening nut 86 is screwed onto the threaded tip portion 83*a* of the fastening bolt 83.

Thus, when a difference in thermal expansion occurs in the radial direction between the inside diffuser 52 and the first seal housing 73, the first flange portion 81 and the second flange portion 82 are displaced in the radial direction, exerting a shearing force on the fastening bolts 83 in the radial direction. However, since the large diameter portion 83*b* of the fastening bolt 83, for which sufficient strength can be secured, passes through the through-hole 81*a*, breakage of the fastening bolt 83 can be inhibited. Specifically, when the inside diffuser 52 and the first seal housing 73 are displaced in the radial direction, the shearing force acts on the large diameter portion 83*b* of the fastening bolt 83. The fastening bolt 83, however, can have the large diameter portion 83*b* with a sufficient thickness, which inhibits the breakage of the fastening bolt 83.

Note that in the above-described embodiment, although the inner cylinder 60 is divided into multiple parts in the circumferential direction, namely, into the upper casing 72 and the lower casing, the inner cylinder 60 may be configured by a ring member that is integrally formed in the circumferential direction.

Further, in the above-described embodiment, although the plurality of notched portions 82*a* are formed in the second flange portion 82 of the first seal housing 73 in the circumferential direction at predetermined intervals, instead of the notched portions 82*a*, long holes extending along the radial direction or through-holes each having a diameter larger than that of the through-hole 81*a* may be adopted.

Further, in the above-described embodiment, the through-holes 81*a* are formed in the first flange portion 81 of the inside diffuser 52, the notched portions 82*a* are formed in the second flange portion 82 of the first seal housing 73, each of the fastening bolts 83 passes through the through-hole 81*a* and the notched portion 82*a* from the inside diffuser 52 side, and the disc spring (urging member) 85 is disposed on the fastening bolt 83, before the fastening nut 86 is screwed onto the threaded tip portion 83*a*, but the above-described embodiment is not limited to this configuration. Another configuration is also possible in which, for example, notched portions (or long holes) are formed in the first flange portion 81 of the inside diffuser 52, through-holes are formed in the second flange portion 82 of the first seal housing 73, and each fastening bolt passes through the through-hole and the notched portion from the first seal housing 73 side, and a disc spring (urging member) is disposed on the fastening bolt, before a fastening nut is screwed onto a threaded tip portion of the fastening bolt. Further, the disc spring (urging member) may be provided between the first flange portion 81 and the second flange portion 82.

Further, in the above-described embodiment, although the recessed fitting portion 101 is provided in the first seal housing 73 and the protruding fitting portion 102 is formed in the second seal housing 74 so as to form the supporting coupling part 75, a protruding fitting portion may be provided in the first seal housing 73, and a recessed fitting portion may be formed in the second seal housing 74. Furthermore, the supporting coupling part 75 is designed to couple the first seal housing 73 with the second seal housing 74 so that the first seal housing 73 and the second seal housing 74 are movable in the axial direction, and is not limited to the recessed fitting portion 101 and the protruding fitting portion 102.

Further, in the above-described embodiment, it is assumed that the amount of thermal expansion (the amount of plastic strain) in the exhaust diffuser 31, which is cooled, is different from that in the front exhaust chamber 42, which is not cooled. Even when different materials are used for the exhaust diffuser 31 and the front exhaust chamber 42, the present invention is effective since the amount of plastic strain in the exhaust diffuser 31 differs from that in the front exhaust chamber 42.

REFERENCE SIGNS LIST

11 Compressor
12 Combustor
13 Turbine
21 Compressor casing
26 Turbine casing
27 Vane
28 Blade
29 Exhaust casing
30 Exhaust chamber
31 Exhaust diffuser
32 Rotor (rotating shaft)
42 Front exhaust chamber
43 Rear exhaust chamber
51 Outside diffuser
52 Inside diffuser (first casing)
53 Strut shield
55 Strut
59 Outer cylinder
60 Inner cylinder (fourth casing)
61 Hollow strut
64 Seal member
71, 72 Upper casing
73 First seal housing (second casing)
74 Second seal housing (third casing)
75 Supporting coupling part
81*a* Through-hole
82*a* Notched portion
83 Fastening bolt
85 Disc spring (urging member)
86 Fastening nut
101 Recessed fitting portion
102 Protruding fitting portion
103 Second seal housing
106 Seal packing (seal member)
108 Dividing portion

The invention claimed is:

1. A gas turbine exhaust member comprising:

an outside diffuser;

an inside diffuser radially inward and coupled to the outside diffuser, wherein both of the outside diffuser and the inside diffuser are formed in a tubular shape, and the inside diffuser is divided into two parts in a circumferential direction by horizontal dividing surfaces;

a first seal housing having a front end in an axial direction coupled to a rear end of the inside diffuser in the axial direction, wherein the first seal housing is tubular shaped and is integrally formed in the circumferential direction;

a second seal housing having a front end in the axial direction coupled to a rear end of the first seal housing in the axial direction, wherein the second seal housing is tubular shaped and is integrally formed in the circumferential direction; and an inner cylinder having a front end in the axial direction that is coupled to a rear end of the second seal housing in the axial direction, wherein the inner cylinder is tubular shaped and is divided into two parts in the circumferential direction, wherein the first seal housing, the second seal housing and the inner cylinder define a combustion gas flow path, and wherein the first seal housing and the second seal housing include:

a recessed portion provided on one of the first seal housing and the second seal housing; and a protruding portion provided on the other of the first seal housing and the second seal housing, the protruding portion being slidably fitted into the recessed portion so as to allow the rear end of the first seal housing and the front end of the second seal housing to move relative to each other in the axial direction.

2. The gas turbine exhaust member according to claim 1, wherein the front end of the first seal housing, in a combustion gas flow direction, is disposed on a downstream side of a rear end of a rotating shaft disposed inside the inside diffuser, and the front end of the first seal housing is separated from the rear end of the rotating shaft.

3. The gas turbine exhaust member according to claim 1, wherein a seal member seals a gap between the second seal housing and the first seal housing.

4. The gas turbine exhaust member according to claim 1, wherein a first flange portion being ring shaped is provided on the rear end of the inside diffuser, a second flange portion being ring shaped is provided on the front end of the first seal housing, a plurality of through-holes are formed in one of the first flange portion and the second flange portion along the circumferential direction, a plurality of notched portions extending in a radial direction are formed in the other of the first flange portion and the second flange portion along the circumferential direction, fastening bolts pass through the through-holes and are inserted through the notched portions, urging members are disposed adjacent to the notched portions, fastening nuts are screwed onto threaded tip portions of the fastening bolts, and each of the notched portions is open on an inner circumferential side of the second flange portion.

5. The gas turbine exhaust member according to claim 1, wherein a front end of the inside diffuser is directly connected to a rear end of a turbine of the gas turbine.

6. An exhaust chamber maintenance method for an exhaust chamber that includes:

an outside diffuser;

an inside diffuser disposed inside the outside exhaust diffuser, the inside diffuser being tubularly shaped and divided into two parts in a circumferential direction by horizontal dividing surfaces;

a first seal housing being tubularly shaped is integrally formed in the circumferential direction, a front end of the first seal housing in an axial direction being coupled to a rear end of the inside diffuser in the axial direction;

a second seal housing being tubularly shaped is integrally formed in the circumferential direction, a front end of the second seal housing in the axial direction being coupled to a rear end of the first seal housing in the axial direction;

wherein the first seal housing and the second seal housing include:

a recessed portion provided on one of the first seal housing and the second seal housing; and a protruding portion provided on the other of the first seal housing and the second seal housing, the protruding portion being slidably fitted into the recessed portion so as to allow the rear end of the first seal housing and the front end of the second seal housing to move relative to each other in the axial direction; and an inner cylinder that is tubularly shaped and divided into two parts in the circumferential direction, a front end of the inner cylinder in the axial direction being coupled to a rear end of the second seal housing in the axial direction, wherein the first seal housing, the second seal housing and the inner cylinder define a combustion gas flow path, and wherein a rear end of a rotating shaft disposed inside the inside diffuser is upstream of the first seal housing with respect a flow direction of the combustion gas, the exhaust chamber maintenance method comprising the steps of:

releasing fastening of the dividing surfaces of the inside diffuser;

releasing fastening between the inside diffuser and the first seal housing; and removing the dividing surfaces of the inside diffuser.

7. A gas turbine exhaust member comprising:

an outside diffuser;

an inside diffuser disposed in the outside diffuser, the inside diffuser being tubularly shaped and divided into two parts in a circumferential direction by horizontal dividing surfaces;

a first seal housing, which is tubularly shaped and integrally formed in the circumferential direction, a front end of the first seal housing in an axial direction being coupled to a rear end of the inside diffuser in the axial direction;

a second seal housing, which is tubularly shaped, is integrally formed in the circumferential direction, a front end of the second seal housing in the axial direction being coupled to a rear end of the first seal housing in the axial direction, wherein the first and second seal housings are disposed inside the outside diffuser;

and an inner cylinder, which is tubularly shaped and divided into multiple parts in the circumferential direction, wherein a front end of the inner cylinder in the axial direction is coupled to a rear end of the second seal housing in the axial direction, wherein the first seal housing, the second seal housing, and the inner cylinder define a combustion gas flow path, and wherein the first seal housing and the second seal housing include:

a recessed portion provided on one of the first seal housing and the second seal housing, and a protruding portion, which is slidably fitted into the recessed portion, provided on the other one of the first seal housing and the second seal housing so as to allow the rear end of the first seal housing and the front end of the second seal housing to move relative to each other in the axial direction.

8. The gas turbine exhaust member according to claim 7, further comprising:

a seal member configured to come in contact with a sliding surface where the recessed portion and the protruding portion slide relative to each other, and a third seal housing configured to press the seal member toward the sliding surface, when moving the recessed portion and the protruding portion relative to each other so as to decrease a distance between the recessed portion and the protruding portion.

9. The gas turbine exhaust member according to claim 7, wherein the supporting coupling part further includes:

a seal packing configured to seal a gap between the second seal housing and the first seal housing, a flange portion provided on one of the second seal housing and the first seal housing, and a third seal housing in close contact with the second seal housing, wherein the seal packing, which is interposed between the flange portion and the third seal housing, is configured to seal the gap between the recessed portion and the protruding portion, when the seal packing is crushed in the axial direction and deforms so as to protrude outward in a radial direction.

* * * * *